US005119885A

United States Patent [19]

Johnson

[11] Patent Number: 5,119,885

[45] Date of Patent: Jun. 9, 1992

[54] ELEMENT BASKET FOR HORIZONTAL ROTARY REGENERATIVE HEAT EXCHANGER

[75] Inventor: Kenneth A. Johnson, Erin, Tenn.

[73] Assignee: ABB Air Preheater, Inc., Wellsville, N.Y.

[21] Appl. No.: 669,129

[22] Filed: Mar. 13, 1991

[51] Int. Cl.[5] ..... F28D 19/04

[52] U.S. Cl. ..... 165/8; 165/10; 29/890.034

[58] Field of Search ..... 165/8, 10; 29/890.034

[56] References Cited

U.S. PATENT DOCUMENTS 4,209,060 6/1980 Wibing et al. ..... 165/8
4,552,204 11/1985 Bellows ..... 165/10
4,789,024 12/1988 Muscato ..... 165/10

FOREIGN PATENT DOCUMENTS 2377599 9/1978 Fed. Rep. of Germany ..... 165/10

*Primary Examiner*—Albert W. Davis, Jr.
*Attorney, Agent, or Firm*—Paul J. Lerner

[57] ABSTRACT

An improved element basket for a rotary air preheater includes a tubular structural element disposed in each of the four corners of the basket frame and extending therethrough in mutually parallel relation. During installation of the basket into the preheater rotor, rods are provided each having an attachment member formed in one end. The rods are inserted into the tubular elements and retaining clamps are attached thereto to prevent withdrawal. A chain or rope is attached to the attachment members, thus allowing the basket to be conveniently drawn into a desired position in the rotor.

2 Claims, 2 Drawing Sheets

ELEMENT BASKET FOR HORIZONTAL ROTARY REGENERATIVE HEAT EXCHANGER

BACKGROUND AND SUMMARY OF THE INVENTION

The present invention relates to rotary regenerative heat transfer devices and, more particularly, to air preheaters wherein the individual heat transfer elements are stacked in open baskets which, in turn, are disposed in compartments in the rotor of the transfer device.

Air preheaters utilize the heat that would otherwise be lost out the smoke stacks of industrial and central power station boilers. In the preheater, this waste heat is captured before it reaches the stack and is transferred to the incoming cold air. Thousands of specially formed steel sheets—called heat transfer elements—absorb the waste heat from hot gases flowing through one half of the preheater structure—and release it to the incoming cold air as it passes through the other half of the structure. The heat transfer elements are spaced and arranged in a cylindrical shell called the rotor. The spaces between the elements allow the air and gas streams to flow across the surface of each sheet. The rotor revolves slowly within the preheater structure, carrying the elements alternately through the air and gas streams so that there is a continuous transfer of heat.

In use, heat transfer elements suffer, to a greater or lesser extent, from corrosion which ultimately necessitates their replacement. As a means of facilitating the efficient removal and replacement of the heat transfer elements in an air preheater, it is the common practice to stack the individual elements in baskets which are inserted into compartments formed in the rotor. The most common method of installing these baskets in the rotor compartments involves field welding attachment lugs to the corners of the basket, passing a chain or rope through the lugs, and then pulling the basket into position with a pulley, winch or pneumatic tugger. Alternatively, the basket may be pushed into position with a pneumatic or hydraulic ram device. Both of these installation methods, however, are time-consuming, resulting in excessive amounts of costly equipment downtime.

It is, therefore, a primary object of the present invention to provide an element basket, for an air preheater or similar heat transfer device, which may be readily installed in the preheater rotor and to further provide a method for the ready installation of the element basket. It is a further object to provide such an element basket which is inexpensive and is compatible with existing heat transfer devices.

The foregoing and other objects as may hereinafter appear are achieved by an element basket which includes a tubular structural element disposed in each of the four corners of the basket frame and extending therethrough in mutually parallel relation. During installation of the basket into the preheater rotor, rods are provided, each having an attachment member formed in one end. The rods are inserted into the tubular elements and retaining clamps are attached thereto to prevent withdrawal. A chain or rope is attached to the attachment members, thus allowing the basket to be conveniently drawn into a desired position in the rotor. The need for welding of attachment lugs is thus eliminated resulting in a significant reduction of installation time. Further, the tubular elements replace solid rod elements heretofore employed in the basket structure, thereby effecting a material cost reduction.

DESCRIPTION OF THE PREFERRED EMBODIMENT

Figure 1:
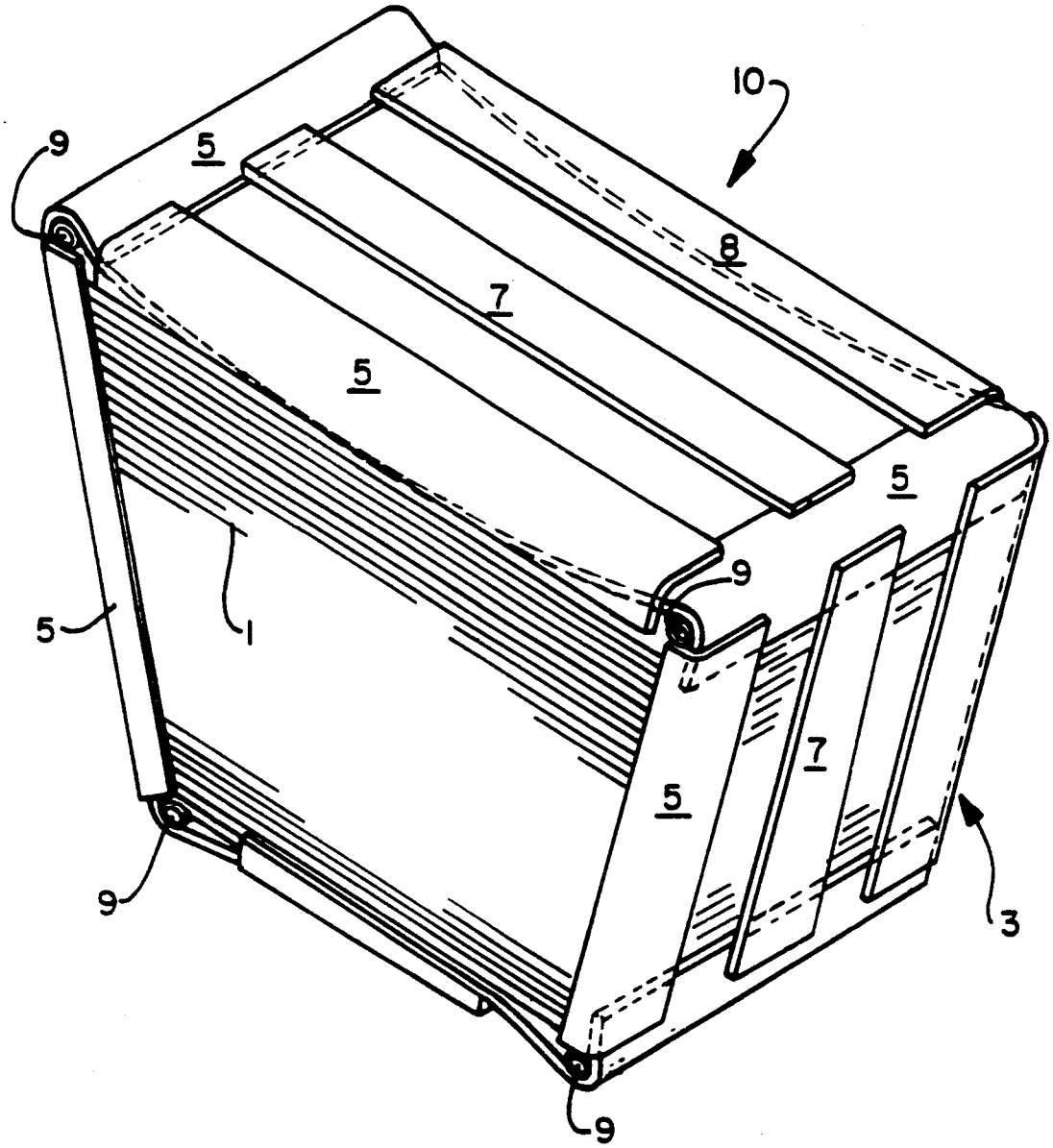
FIG. 1 is a perspective view of an element basket arranged in accord with the present invention.
Figure 2:
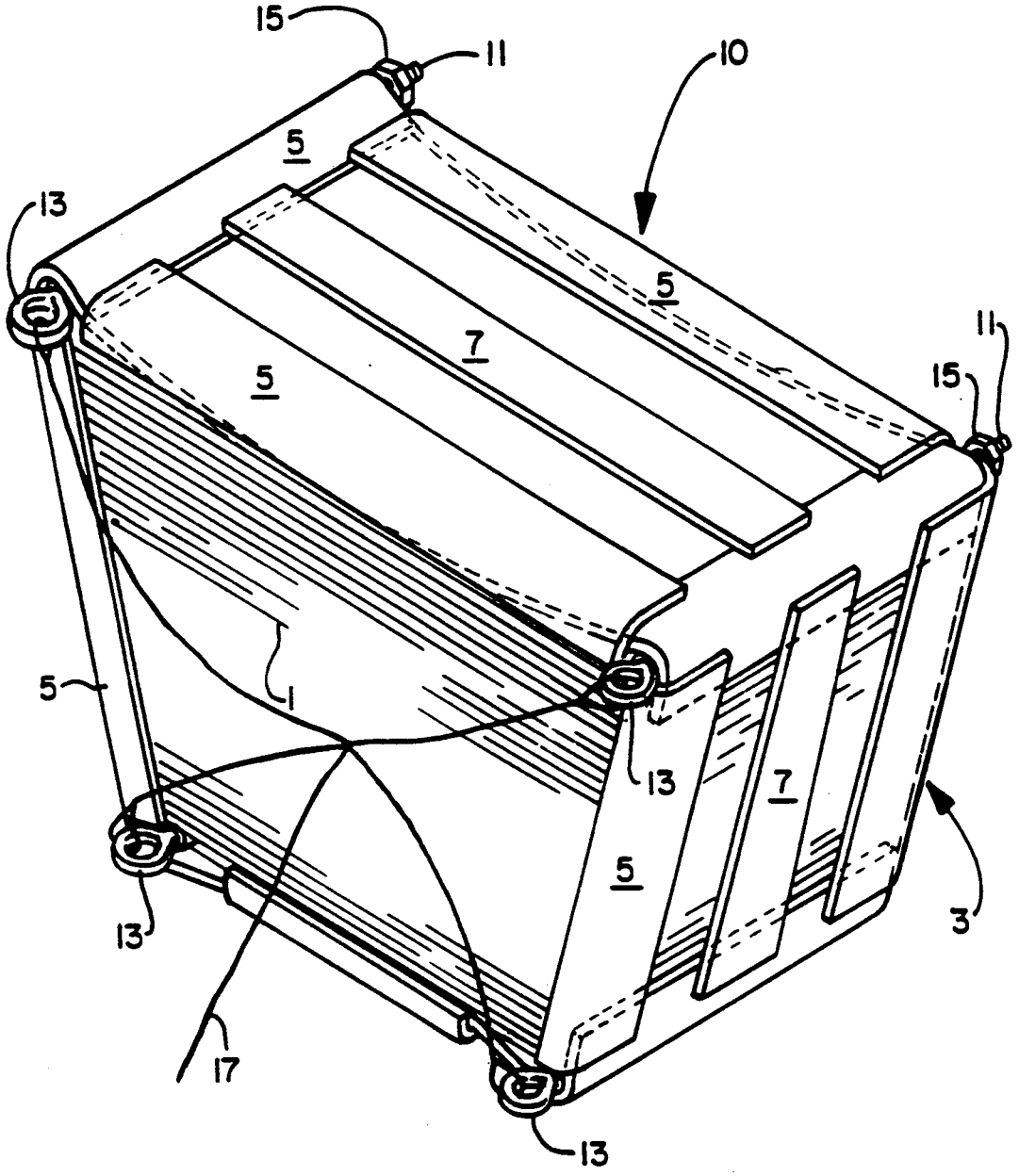
FIG. 2 is a perspective view of the element basket of FIG. 1, ready for installation into a preheater rotor.

Turning now to the drawing, there is shown in FIG. 1 an element basket 10 comprising a number of individual heat transfer elements 1 retained in an open frame 3 assembled from curved steel corner elements 5 and planar steel side elements 7 welded together. Four tubular steel structural elements 9 are disposed in four corners of frame 3 and extend therethrough in mutually parallel relation, providing uninterrupted passage through element basket 10. Tubular structural elements 9 replace solid rods heretofore utilized as frame structural elements.

For installation of element basket 10 in the rotor of a rotary regenerative heat transfer device (not shown), there are provided four rigid rods 11 adapted to be inserted into the four tubular structural elements 9. Rods 11 each have an attachment lug 13 formed in one end and are of a sufficient length to extend through element basket 10 and project therebeyond. Rods 11 are inserted into tubular structural elements 9 and a retaining clamp 15, which may conveniently be a conventional cable clamp, is attached to the projecting distal portion of each rod 11 so as to prevent withdrawal of rods 11 from tubular structural elements 9. A flexible tensionable member 17, which may be a rope, cable or chain, is attached to attachment lugs 13, whereupon element basket 10 may be drawn into a desired position in the rotor by pulling on tensionable member 17, which may be done with a pulley, winch or pneumatic tugger.

I claim:

1. In an element basket for a rotary regenerative heat transfer device, said element basket comprising a plurality of heat transfer elements and a frame for holding said heat transfer elements; the improvement comprising four tubular structural elements disposed one each in four corners of said frame and extending therethrough in mutually parallel relation.

2. An improved method of installing an element basket in the rotor of a rotary regenerative heat transfer device, comprising the steps of:

providing the element basket with a plurality of tubular structural elements, each providing uninterrupted passage through said element basket;

inserting one of said rods into each of said tubular structural elements, with a distal portion of each rod projecting therefrom;

providing a plurality of retaining clamps adapted for attachment to said rods;

attaching one of said retaining clamps to said projecting distal portion of each of said rods, said retaining clamps preventing withdrawal of said rods from said tubular structural elements;

providing a flexible tensionable member;

attaching said tensionable member to said attachment members; and drawing said element basket into a desired position in said rotor by pulling on said tensionable member.

* * * * *